United States Patent [19]

Agnew, Sr.

[11] 4,245,682

[45] Jan. 20, 1981

[54] ATTACHMENT FOR DISPENSING NOZZLE

[75] Inventor: Robert A. Agnew, Sr., Chattanooga, Tenn.

[73] Assignee: Agnew & Sons Company, Chattanooga, Tenn.

[21] Appl. No.: 31,033

[22] Filed: Apr. 18, 1979

[51] Int. Cl.[3] ..... B65B 3/04; B25F 1/00

[52] U.S. Cl. ..... 141/392; 7/100; 74/526; 251/90

[58] Field of Search ..... 7/100; 74/526; 141/98, 141/392, 206–209; 248/1, 360; 251/90, 101, 102

[56] References Cited

U.S. PATENT DOCUMENTS

| | | | |
|---|---|---|---|
| 2,761,510 | 9/1956 | Stough | 74/526 |
| 4,175,595 | 11/1979 | Noe | 141/392 X |

*Primary Examiner*—Frederick R. Schmidt

*Attorney, Agent, or Firm*—Charles E. Baxley

[57] ABSTRACT

A gasoline pump handle insert for wedging the pump handle lever in a pump open condition. A shank, offset to one side supports spaced protrusions on one end and spaced bosses on the other to form respective bights to engage the pump handle and lever. A clip with a sharp edge for scraping windshield ice and a holder for pencils and pens also can be provided.

2 Claims, 4 Drawing Figures

ATTACHMENT FOR DISPENSING NOZZLE

This invention relates to a new device for a "self-service" gasoline pump handle and, more particularly, to a wedge for keeping the pump handle lever in the open position, and the like.

As automotive fuels and labor become more expensive, it is necessary to develop techniques for reducing gasoline station operating costs. In this regard, "self-service" gasoline stations, in which the motorist operates the gasoline pump are becoming popular once more. Stations of this type require fewer attendants because the customers do much of the routine work of pumping gas, checking oil, and so forth. In these circumstances, fuel can be sold at a lower price because the station manager's labor costs are reduced.

For various reasons, the device on the gasoline pump handle that holds the handle lever in the open position to enable the automobile fuel tank to fill with gas while the station attendant cleans windshields, checks the oil, battery water and engine coolant levels has been removed from "self-service" pumps. Thus, in a "self-service" station, the customer must continue to press the gasoline pump handle lever until the desired quantity of fuel has been added to the tank. In spite of this requirement for steady manual operation, however, the automatic cut-off on these pump handle that stops gasoline flow as the fuel in the tank reaches a predetermined level remains functional. Thus, the motorist is occupied with the task of pressing a lever on a pump handle that will nevertheless automatically stop the flow of fuel when the proper level is reached. The motorist, of course, ordinarily would prefer during this time to engage in the more productive work that usually characterized the activity of the paid gasoline station attendant.

In addition to this foregoing need, there are a number of other automobile accessories that are generally useful. Illustratively, a windshield ice scraper or a pencil or pen holder with provisions for advertising space, all having some means for attachment within the passenger compartment of a vehicle would be valuable. For any number of reasons the usual ice scrapers, pen holders and other devices of this type seldom, if ever, seem to be satisfactory. Often, for example, these devices are too expensive or too flimsy.

Thus, there is a need for a suitable device that will permit a motorist to keep the gas pump handle lever in the operating or open position without requiring a continuous application of manual force.

There is a further need not only for a sturdy, inexpensive windshield ice scraper, but also for a pencil or pen holder that can be mounted with relative ease within the passenger compartment of an automobile.

These and other needs are satisfied, to a large extent, through the practice of the invention. Illustratively, an insert is provided that can be wedged between the gasoline pump handle lever guard and the handle lever in order to press the lever into the open or operating position without imposing a requirement for an application of steady manual force. To simplify manipulation of the insert, an offset handle is provided to afford the motorist a good grip on the device as it is being wedged between the lever and the lever guard on the pump handle.

This offset handle, however, is formed into a clip that is open at one end, thereby serving the multiple purposes of providing a hand grip, a clip for attaching the device to the sun visor in the passenger compartment of the vehicle, a convenient advertising space and a means for reducing the material needed in the manufacture of the insert while still providing a sturdy piece of equipment. Further in this regard, by bevelling at last one of the side so the hand grip, the insert also can be used to scrape windhshield ice.

The portion of the insert, moreover, that receives the handle lever also can be provided with a small extension to accommodate a receptacle for a pencil or a pen.

For a better understanding of the present invention together with other and further objects thereof, reference is had to the following description taken in connection with the accompanying drawing, the scope of the invention being pointed out in the appended claims.

Figure 1:
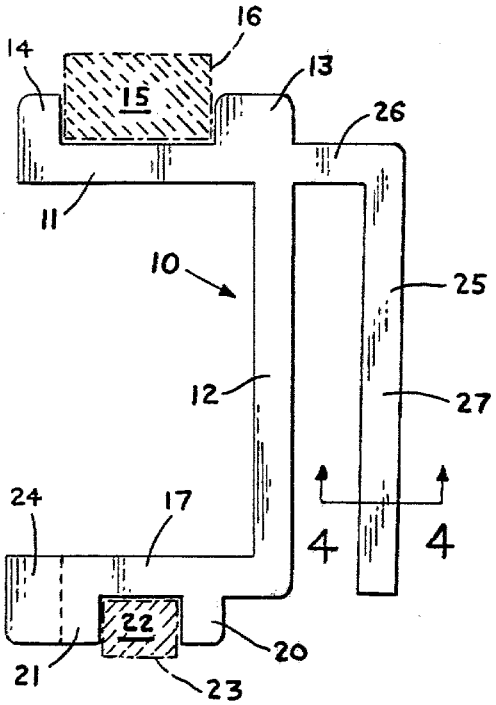
FIG. 1 is a front elevation of a typical embodiment of the invention.

For a more complete appreciation of the invention, attention is invited to FIG. 1 which shows a gasoline pump handle insert or wedge 10. One portion of the insert 10 is provided with a generally flat member 11 which protrudes perpendicularly from a straight shank 12. The flat member 11 has two protrusions 13, 14 which extend in the longitudinal direction of the shank 12. The protrusions 13, 14 also are spared transversely from each other, the protrusion 13 being in general alignment with the shank 12 and the protrusion 14 being located at the extreme end of the flat member 11 that is opposite to the shank 12.

This spacing between the protrusions 13, 14 forms a bight 15 that receives a gasoline pump lever guard 16 (shown in phantom section in FIG. 1). To accommodate the lever guard on most gasoline pump handles, a depth of bight of about 5/16" and a spacing of 1 1/16" between the protrusions 13, 14 has been found satisfactory.

Another flat member 17 protrudes from the end of the shank 12 that is opposite to the member 11. The member 17 also is equipped with a pair of transversely spaced bosses 20, 21, the boss 21 being spaced further from the shank 12. The bosses 20, 21 form a bight 22 that receives a gasoline pump handle lever 23 (also shown in phantom section). Further in this regard, it has been found that the bight 22 should have a depth of about 5/16" and a width of about 9/16" in order to accept standard gasoline pump handle levers.

Figure 2:
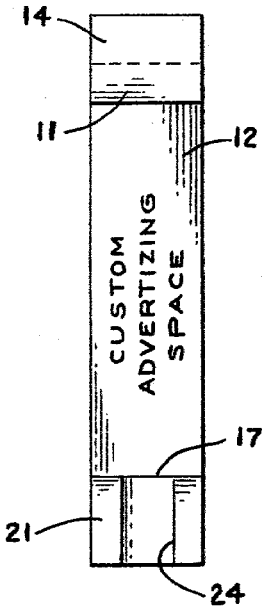
FIG. 2 is a side elevation of the embodiment of the invention that is shown in FIG. 1.

A pencil or pen holder 24 (FIGS. 1 and 2) formed in the shape of a slighty resilient recess in the extreme end of the flat member 17 also is provided in one side of the boss 21.

To adequately depress a standard gasoline pump lever through a sufficient distance to permit fuel to flow from the usual commercial gasoline pump, it has been found that an overall length for the shank 12 of about 2¾" is suitable.

In accordance with a feature of the invention, and contrary to ordinary expectations, the shank 12 is not interposed between the flat members 11, 17 in direct longitudinal alignment with the lever guard 16 and the lever 23, but is offset to one side of the lever and lever guard assembly. The shank 12, in this offset position, actually makes it easier for the motorist to wedge the insert 10 between the lever guard 16 and the lever 23. The offset shank also provides a resilient clip 25 for attaching the insert 10 to the sun visor in the passenger compartment of a vehicle when the insert is not otherwise in use.

As shown in FIG. 1, the clip 25 comprises an "ell" which has a short stub 26 that connects a longitudinal shaft 27 to the shank 12. The stub 26 is perpendicular to the shaft 27 and extends transversely between the shaft and one end of the shank 12 to join these two members together at the side of the shank that is adjacent to the flat member 11. The shaft 27, moreover, is about the same length as the shank 12 and is generally parallel with the shank.

Figure 3:
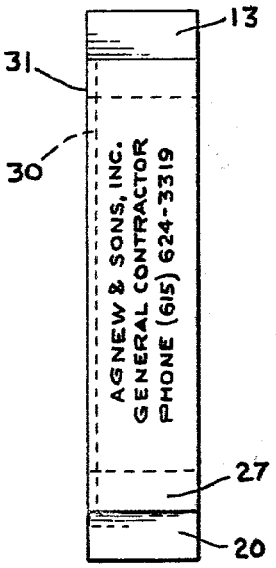
FIG. 3 is an elevation of another side of the embodiment of the invention that is shown in FIG. 1.
Figure 4:
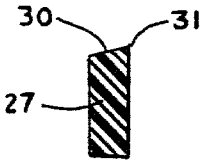
FIG. 4 is a view in full section of a portion of the device that is shown in FIG. 1, viewed in the direction of the arrows A—A of FIG. 1.

In accordance with another feature of the invention, the shaft 27 (FIGS. 3 and 4) has an undercut bevelled side 30 that forms a sharp, exposed edge 31 for removing ice from an automobile windshield. This combination hand grip and resilient clip that is formed by means of the shank 12, the shaft 27 and the interconnecting stub 26 forms a gap that is about ½" wide near the stub 26 and narrows at the open end to a width of 7/16". This narrowing, when taken with the inherent resiliency of the material from which the insert 10 is formed, enables the clip 25 to grasp a sun visor (not shown) in the passenger compartment with sufficient force to remain on the visor in most driving conditions. The force that the clip 25 applies, however, permits the insert 10 to be removed from the sun visor with relative ease and without damaging visor material.

The shaft 27 (FIG. 3) and the shank 12 (FIG. 2) also provide conveniently prominent spaces for a display of advertising material, driver safety slogans and the like.

In operation, the insert 10 is removed from the sun visor in an automobile by grasping the protrusion 13 (FIG. 1) and pulling the insert away in a longitudinal direction. The gas pump handle lever 23 is manually depressed and the insert 10 is wedged between the lever guard 16 and the lever. The spring forces in the pump handle (not shown) press the insert 10 between the lever 23 and the guard 16 and thus permit fuel to flow from the pump until the automatic cut-off within the pump handle stops the flow of fuel independently of the relative position of the lever 23.

To remove the insert 10, it is only necessary to grasp the handle and clip combination and tilt the insert 10 out of the plane of the drawing for FIG. 1. Naturally, while the insert 10 is wedged in the pump handle, the pen or pencil lodged in the holder 24 preferably should be temporarily removed.

To use the insert 10 to scrape ice from a windshield, the shank 12 and the shaft 27 should be grasped tightly. The edge of the bevelled side 30 then should be pressed against the windshield ice, which then can be removed by sweeping the insert 10 across the windshield. In this way, the gap between the shank 12 and the shaft 27 not only combine to provide a convenient clip for automotive use, but also reduces the quantity of material needed in the manufacture of an insert and cooperates to afford a convenient, stabilizing hand grip for ice scraper utilization.

Although the device that characterized this invention can be formed from any number of suitable materials, it has been found that flexible plastic stock about 3/16" thick produces the best results.

I claim:

1. A gasoline pump handle insert for wedging the pump handle lever in a pump open condition relative to the pump handle lever guard comprising a shank, a pair of parallel and longitudinally spaced flat members extending in the same direction from opposite ends of the shank, a pair of transversely spaced protrusions on one of said flat members extending in the same direction as the shank and forming a bight therebetween for engaging the pump handle lever guard, a pair of transversely spaced bosses on the other of said flat members, said bosses protruding longitudinally in the same direction as the shank, said bosses forming a bight for engaging the gas pump handle lever, said shank being offset to one side of said bights a shaft generally parallel with said shank and coextensive therewith, said shaft being spaced from said shank in order to establish an open ended clip, said shaft having a bevelled side forming a sharp edge on said shaft for removing ice from an automobile windshield, and a stub joining said shaft and shank together.

2. An insert according to claim 1 wherein one of said protruding bosses further comprises a holder for pencils and pens.

* * * * *